US005722642A

United States Patent [19]

Bradshaw

[11] Patent Number: 5,722,642

[45] Date of Patent: Mar. 3, 1998

[54] STANDING PRIVACY FENCE WITH A DEPLOYABLE BENCH

[76] Inventor: Terry L. Bradshaw, 531 State Rte. 28 East, Blanchester, Ohio 45107

[21] Appl. No.: 767,248

[22] Filed: Dec. 13, 1996

Related U.S. Application Data

[63] Continuation-in-part of Ser. No. 602,294, Feb. 16, 1996, abandoned.

[51] Int. Cl.[6] ..... E04H 17/00

[52] U.S. Cl. ..... 256/1; 256/24; 297/55

[58] Field of Search ..... 256/1, 26, 12.5, 256/24, 31, 67, 65, 69, 68, 64; 52/36.4; 160/127; 297/55, 58; 124/1, 23.1, 86

[56] References Cited

U.S. PATENT DOCUMENTS

| | | | |
|---|---|---|---|
| 57,672 | 9/1866 | Carlisle | 256/31 |
| 274,532 | 3/1883 | Toman | 256/31 |
| 454,677 | 6/1891 | Braden | 256/31 |
| 937,567 | 10/1909 | Canouts | 297/55 |
| 1,129,793 | 2/1915 | Craig | 297/58 |
| 1,545,909 | 7/1925 | McKinnon | 256/12.5 |
| 1,647,585 | 11/1927 | Sargent | 256/12.5 |
| 2,855,183 | 10/1958 | Moore | 256/26 |
| 4,290,241 | 9/1981 | Tucker | 52/36.4 |
| 5,421,131 | 6/1995 | Heckman et al. | 256/67 X |

FOREIGN PATENT DOCUMENTS

| | | | |
|---|---|---|---|
| 61263 | 8/1943 | Denmark | 256/12.5 |
| 9419545 | 9/1994 | WIPO | 256/1 |

*Primary Examiner*—Harry C. Kim

[57] ABSTRACT

A standing privacy fence which is collapsible and includes a deployable bench is disclosed. A rectangular sheet is formed with parallel upper and lower edges and generally vertical end edges. The sheet comprises a plurality of vertically extending planks and includes strengthening planks. A pair of long supplemental planks having upper edges with pivot pins pivotally secure the upper end of the supplemental planks to the strengthening planks of the sheet adjacent to the upper edge thereof. The supplemental planks are spaced a distance essentially equal to the width of the vertical strengthening planks of the sheet. Additional planks have an intermediate extent with pivot pins coupled to intermediate extents of the supplemental planks. The additional planks have interior ends with removable bolts coupled to an intermediate extent of the strengthening planks for allowing the supplemental planks to retain the sheet and supplemental planks in a rigid A-shaped configuration when the fence is deployed but to allow removal of the removable bolt for pivoting the supplemental and additional planks parallel to the strengthening planks during storage and transportation. The additional planks have transverse seating planks adjacent to the ends thereof remote from the free strengthening planks.

2 Claims, 5 Drawing Sheets

STANDING PRIVACY FENCE WITH A DEPLOYABLE BENCH

RELATED APPLICATION

This application is a continuation-in-part application of U.S. patent application Ser. No. 08/602,294 and filed Feb. 16, 1996, now abandoned.

BACKGROUND OF THE INVENTION

1. Field of the Invention

The present invention relates to a new and improved standing privacy fence with a deployable bench and, more particularly, pertains to providing privacy through a fence while allowing components thereof to be used as a bench.

2. Description of the Prior Art

The use of fences and benches and combinations thereof in various designs and configurations is known in the prior art. More specifically, fences and benches and combinations thereof in various designs and configurations heretofore devised and utilized for the purpose of providing convenient seating capabilities and fence capabilities through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for providing privacy through a fence while allowing components thereof to be used as a bench. By way of example, U.S. Pat. No. 3,767,167 to Rasmussen discloses a portable fence panel for use as a pen or corral.

U.S. Pat. No. 4,067,547 to Peters discloses a fence for feed lots or the like.

U.S. Pat. No. 5,104,074 to Malloy discloses a fence support.

U.S. Pat. No. 5,240,230 to Dougherty discloses a fence panel with integral anchor fitting.

Lastly, U.S. Pat. No. 5,287,909 to King et al. discloses a freestanding privacy screen.

In this respect, the standing privacy fence with a deployable bench according to the present invention substantially departs from the conventional concepts and designs of the prior art, and in doing so provides an apparatus primarily developed for the purpose of providing privacy through a fence while allowing components thereof to be used as a bench.

Therefore, it can be appreciated that there exists a continuing need for a new and improved standing privacy fence with a deployable bench which can be used for providing privacy through a fence while allowing components thereof to be used as a bench. In this regard, the present invention substantially fulfills this need.

SUMMARY OF THE INVENTION

In view of the foregoing disadvantages inherent in the known types of fences and benches and combinations thereof in various designs and configurations now present in the prior art, the present invention provides an improved standing privacy fence with a deployable bench. As such, the general purpose of the present invention, which will be described subsequently in greater detail, is to provide a new and improved standing privacy fence with a deployable bench and methods which have all the advantages of the prior art and none of the disadvantages.

To attain this, the present invention essentially comprises a new and improved standing privacy fence which is collapsible and includes a deployable bench comprising, in combination, a rectangular sheet formed with long parallel upper and lower edges and short generally vertical end edges, the sheet being formed of a plurality of generally vertically extending planks, the sheet including strengthening planks adjacent to the upper and lower edges and side edges; a pair of long supplemental planks having upper edges with pivot pins pivotally securing the upper end of the supplemental planks to the strengthening planks of the sheet adjacent to the upper edge thereof, the supplemental planks being spaced a distance essentially equal to the width of the vertical strengthening planks of the sheet, the supplemental planks being positionable adjacent to the sheet for storage and transportation and being movable away from the sheet to form an A-shaped cross-sectional configuration when the fence is deployed; additional planks having an intermediate extent with pivot pins coupled to intermediate extents of the supplemental planks and having interior ends with removable bolts coupled to an intermediate extent of the strengthening planks for allowing the supplemental planks to retain the sheet and supplemental planks in a rigid A-shaped configuration when the fence is deployed but to allow removal of the removable bolt for pivoting the supplemental and additional planks parallel to the strengthening planks during storage and transportation, the additional planks having transverse seating planks adjacent to the ends thereof remote from the free strengthening planks; and back planks having lower ends with apertures and a pivot pin secured to the strengthening planks adjacent to their upper ends and pivotable to a raised orientation for storage and transportation and pivotable to a lower position during deployment as a fence and bench, the back planks having transverse back rest planks secured thereto.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved standing privacy fence with a deployable bench which has all the advantages of the prior art fences and benches and combinations thereof in various designs and configurations and none of the disadvantages.

It is another object of the present invention to provide a new and improved standing privacy fence with a deployable bench which may be easily and efficiently manufactured and marketed.

It is a further object of the present invention to provide a new and improved standing privacy fence with a deployable bench which is of a durable and reliable construction.

An even further object of the present invention is to provide a new and improved standing privacy fence with a deployable bench which is susceptible of a low cost of manufacture with regard to both materials and labor, and which accordingly is then susceptible of low prices of sale to the consuming public, thereby making such fences and benches and combinations thereof in various designs and configurations economically available to the buying public.

Still yet another object of the present invention is to provide a new and improved standing privacy fence with a deployable bench which provides in the apparatuses and methods of the prior art some of the advantages thereof, while simultaneously overcoming some of the disadvantages normally associated therewith.

Even still another object of the present invention is to provide privacy through a fence while allowing components thereof to be used as a bench.

Lastly, it is an object of the present invention to provide a standing privacy fence which is collapsible and includes a deployable bench. A rectangular sheet is formed with parallel upper and lower edges and generally vertical end edges. The sheet comprises a plurality of vertically extending planks and includes strengthening planks. A pair of long supplemental planks having upper edges with pivot pins pivotally secure the upper end of the supplemental planks to the strengthening planks of the sheet adjacent to the upper edge thereof. The supplemental planks are spaced a distance essentially equal to the width of the vertical strengthening planks of the sheet. Additional planks have an intermediate extent with pivot pins coupled to intermediate extents of the supplemental planks. The additional planks have interior ends with removable bolts coupled to an intermediate extent of the strengthening planks for allowing the supplemental planks to retain the sheet and supplemental planks in a rigid A-shaped configuration when the fence is deployed but to allow removal of the removable bolt for pivoting the supplemental and additional planks parallel to the strengthening planks during storage and transportation. The additional planks have transverse seating planks adjacent to the ends thereof remote from the free strengthening planks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
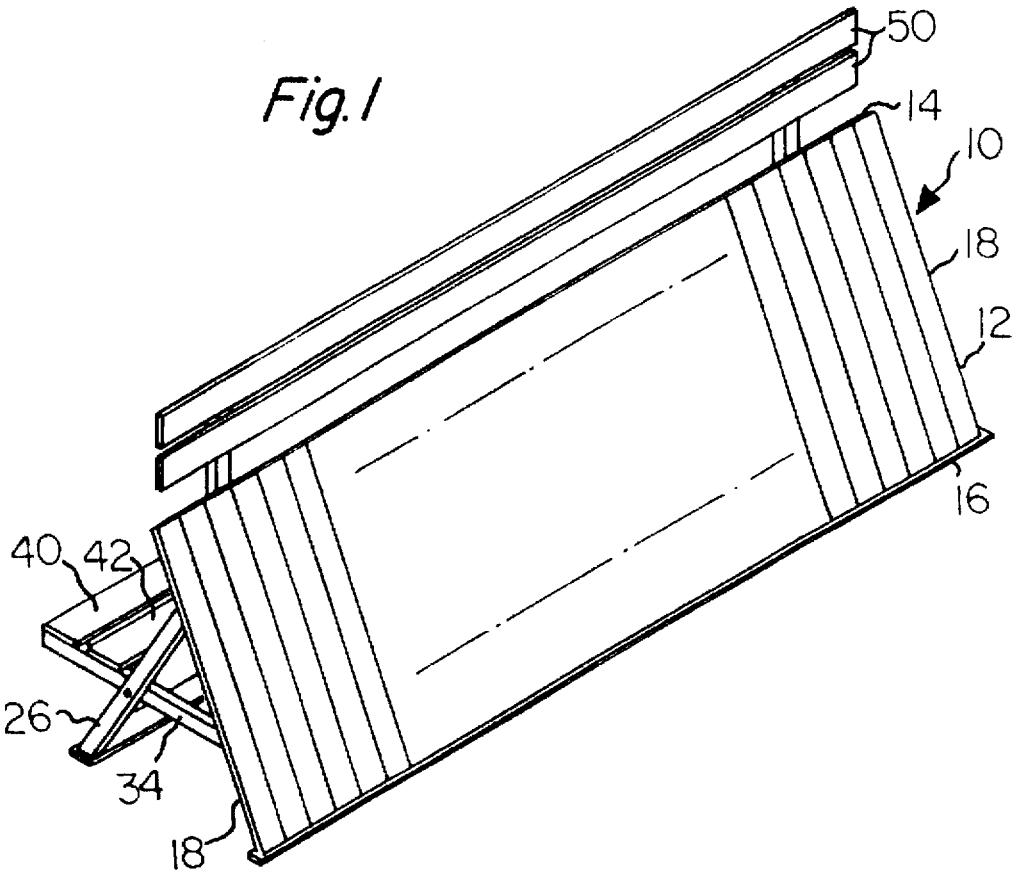
FIG. 1 is a perspective illustration of the a first embodiment of the new and improved standing privacy fence with a deployable bench constructed in accordance with the principles of the present invention.
Figure 5:
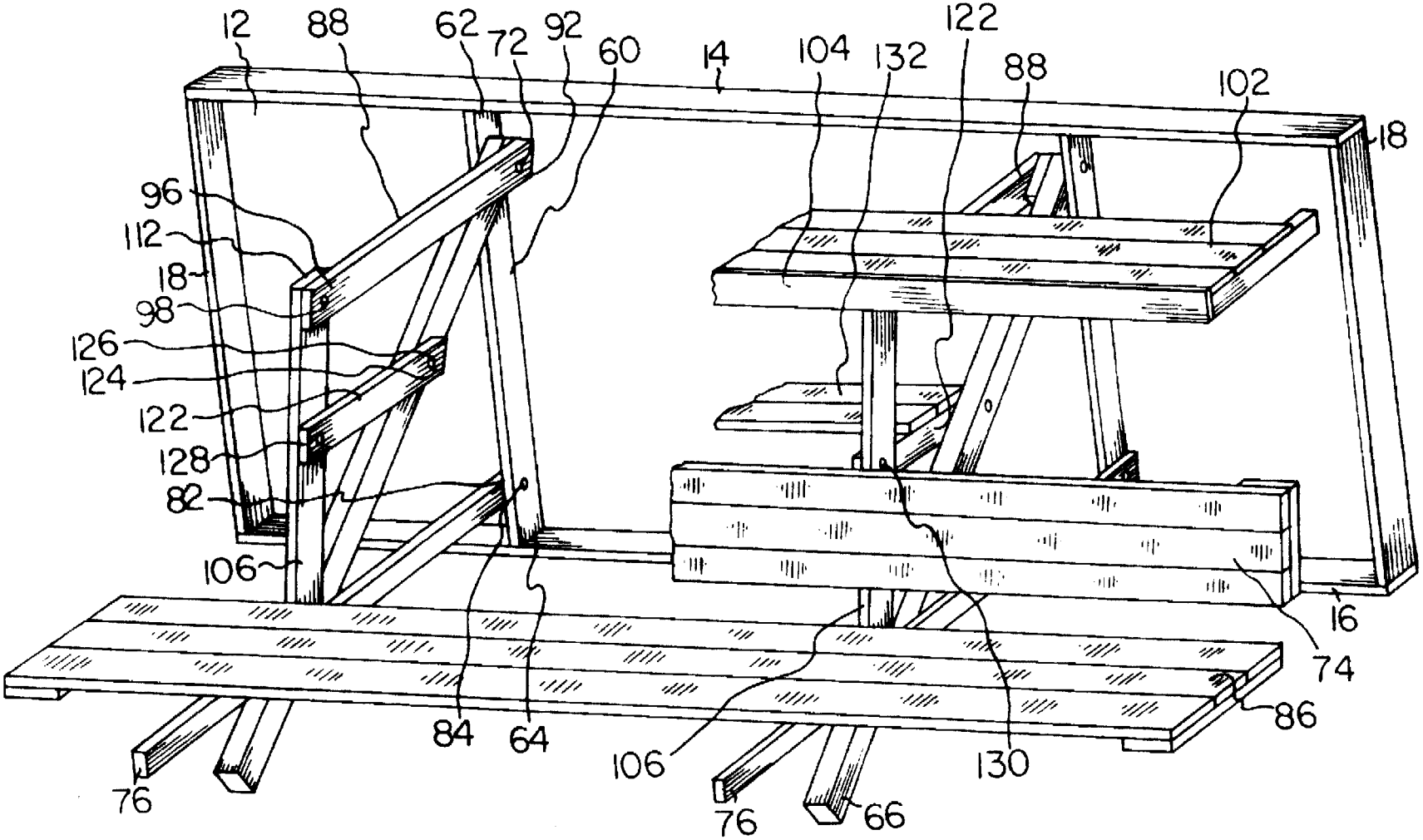
FIG. 5 is a perspective illustration of a second embodiment of the new and improved standing privacy fence with a deployable bench constructed in accordance with the principles of the present invention.

With reference now to the drawings, and in particular to FIGS. 1 and 5 thereof, the preferred embodiment of the new and improved standing privacy fence with a deployable bench embodying the principles and concepts of the present invention and generally designated by the reference numeral 10 will be described.

The present invention, the new and improved standing privacy fence with a deployable bench is a system 10 comprised of a plurality of components. In their broadest context, the components include a rectangular sheet, strengthening planks, a pair of supplemental planks, additional planks and back planks. Each of the individual components is specifically configured and correlated one with respect to the other so as to attain the desired objectives.

A central component of the system 10 of the first embodiment of the present invention is a rectangular sheet 12. Such sheet is formed with long parallel upper and lower edges 14,16. It also includes short, generally vertical, end edges 18 coupling the upper and lower edges. The sheet is formed of a plurality of generally vertically extending planks 20. The sheet includes vertically strengthening planks 22 adjacent to the upper and lower edges as well as with respect to the side edges and a central extent thereof.

Next provided are a pair of long supplemental planks 26. Such supplemental planks have upper edges 28 with pivot pins 30 pivotally securing the upper end of the supplemental planks to the strengthening planks of the sheet adjacent to the upper edge thereof. The strengthening planks are spaced a distance essentially equal to the width of the vertical strengthening planks of the sheet.

Figure 2:
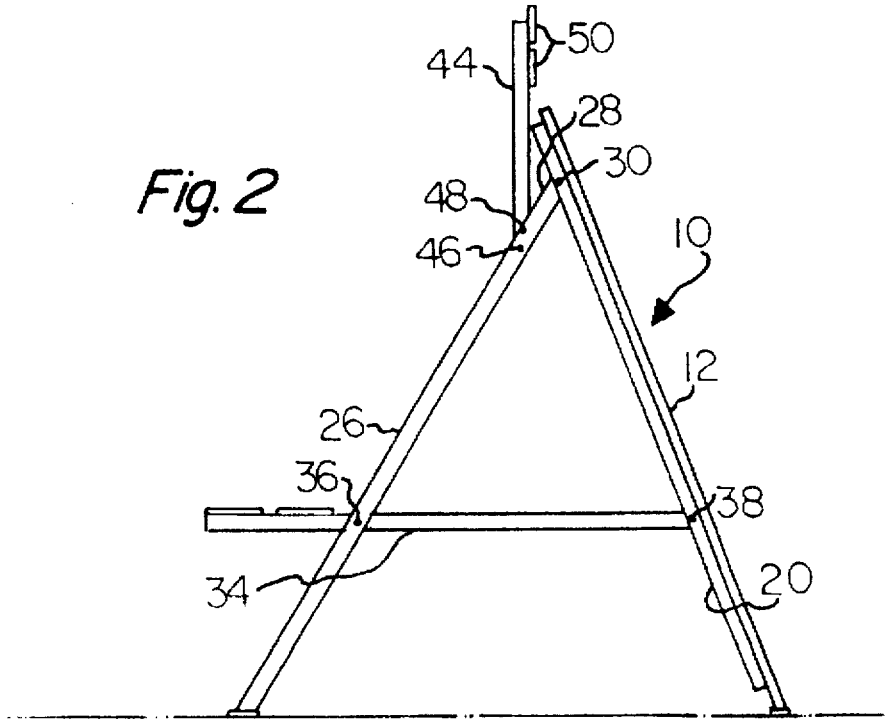
FIG. 2 is a side elevational view of the device shown in FIG. 1.
Figure 3:
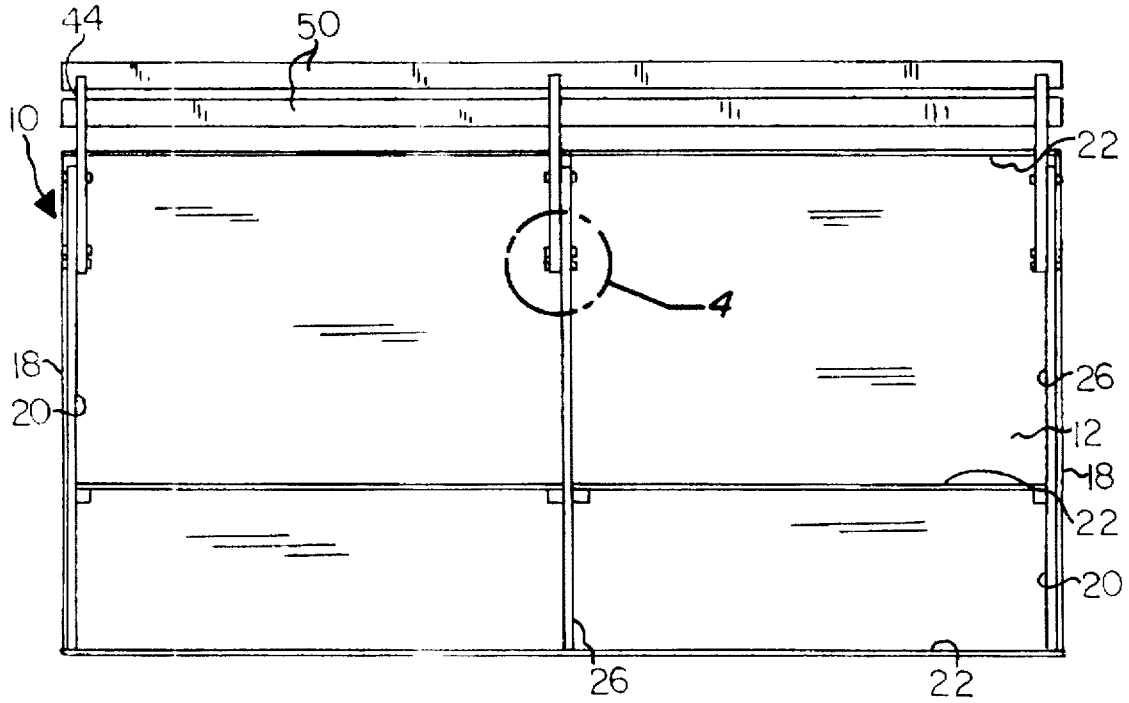
FIG. 3 is a rear elevational view of the device shown in the prior Figures.
Figure 4:
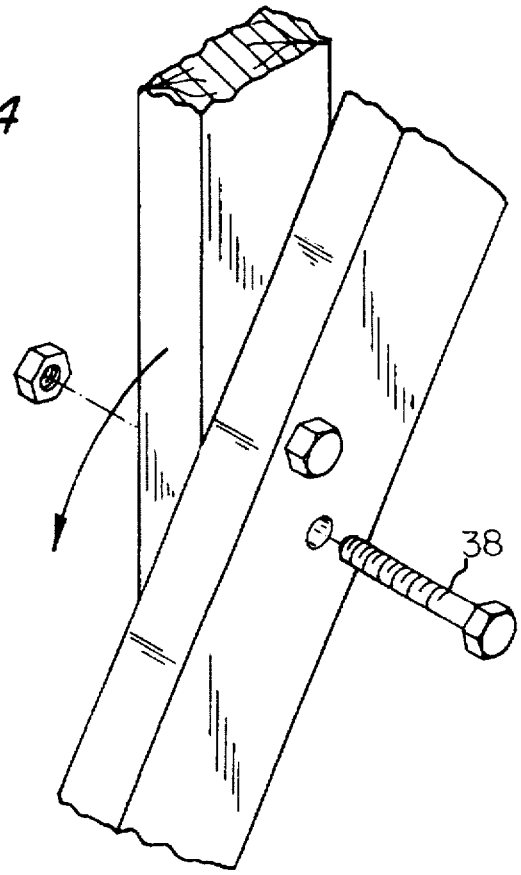
FIG. 4 is an enlarged perspective view of a coupling shown in FIG. 3.

The supplemental planks are positionable adjacent to the sheet for storage and transportation. They are also movable away from the sheet. In such deployed orientation, such planks form an A-shaped cross-sectional configuration for operation and use. Note FIG. 2.

Additional planks 34 are next provided. Such additional planks have intermediate extents with pivot pins 36 coupled to the intermediate extents of the supplemental planks. The additional planks also have interior ends with removable bolts 38. Such removable bolts are for coupling the additional planks to an intermediate extent of the strengthening planks. This allows for the supplemental planks to retain the sheet and supplemental planks in the rigid A-shaped configuration as discussed above when the fence is deployed. The bolts also allow removal of the bolts for pivoting the supplemental and additional planks parallel with the storage planks during storage and transportation. The additional planks are provided with transverse seating planks 40,42 adjacent to the ends thereof remote from the free strengthening planks.

Lastly provided are back planks 44. The back planks have lower ends with apertures and a pivot pin 46 secured to the supplemental planks. Such securement is adjacent to the upper ends of the supplemental planks. In addition, pivot pins 48 are provided to pivot the back planks to a raised orientation for storage and transportation. Note FIG. 2. The back planks are pivotable to a lower position during deployment as a fence and bench. The back planks have transverse back rest planks 50 secured thereto for the receipt of a user's back.

Furthermore, a second embodiment of the present invention includes and is comprised of the identical rectangular sheet 12 of the first embodiment. The sheet is formed with long parallel upper and lower edges 14,16. The sheet has short generally vertical end edges 18 and formed of a plurality of generally vertically extending planks 20.

As shown in FIG. 5, the sheet includes a pair of interior planks 60 for strengthening the sheet 12. The interior planks are proportionately spaced from the end edges of the rectangular sheet and one another. Each interior plank has an upper edge 62 and a lower edge 64. The upper edge of each interior plank is adjacent the long parallel upper edge 14 of the rectangular sheet. The lower edge of each interior plank is adjacent the long parallel lower edge of the rectangular sheet.

As illustrated in FIG. 5, a pair of long supplemental planks 66 are provided. Each of the long supplemental planks have upper edges 68 with pivot pins 72 pivotally securing the upper edges of the supplemental planks to the interior planks 60 of the sheet 12 and adjacent to the upper edge 62. The supplemental planks are spaced a distance from the end edges essentially equal to the spacing of the interior planks of the sheet.

The supplemental planks 66 have transverse backrest planks 74 extending past the supplemental planks to have a length essentially equal to the width of the sheet 12. The supplemental planks are positioned away from the sheet to form a right triangular cross sectional configuration when the fence is deployed.

Figure 6:
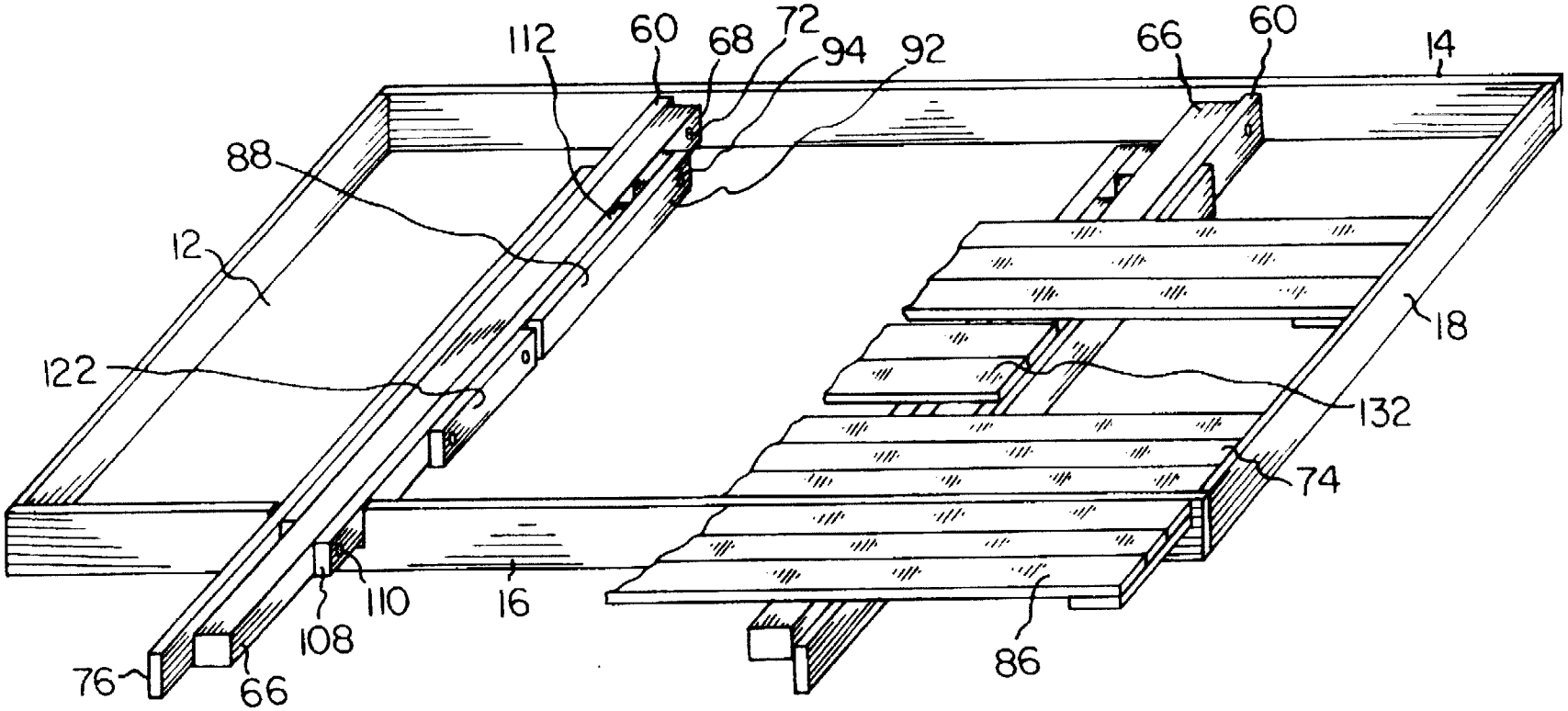
FIG. 6 is a rear view of the device shown in FIG. 5 in a stored orientation.
Figure 7:
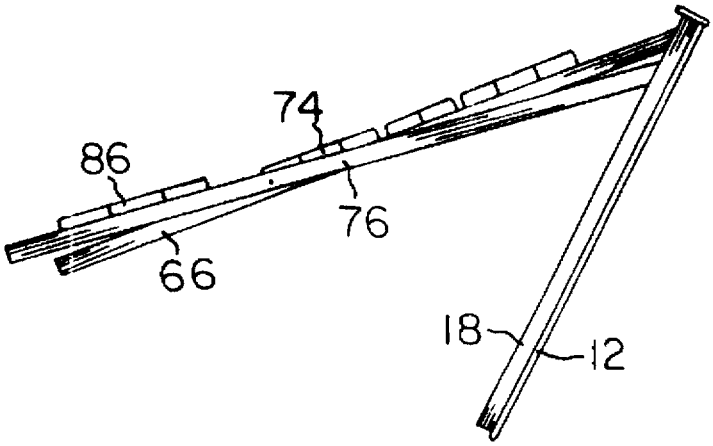
FIG. 7 is a side elevational view of the device shown in FIG. 5 in the first deployment orientation.

Also, additional planks 76 are included. Such additional planks have intermediate extents with pivot pins 78 coupled to intermediate extents of the supplemental planks 66. The additional planks have interior ends 82, with removable bolts 84, coupled to an intermediate extent of the interior planks 60 for allowing the supplemental planks to retain the sheet and supplemental planks in a rigid right triangular configuration. The additional planks are able to retain the triangular configuration when the fence is deployed but, allows removal of the removable bolt for pivoting the supplemental and additional planks parallel to the interior planks during storage and transportation, as shown in FIG. 6. The additional planks have transverse seating planks 86 spaced from the ends thereof remote from the interior planks 60, as seen in FIG. 7.

Figure 8:
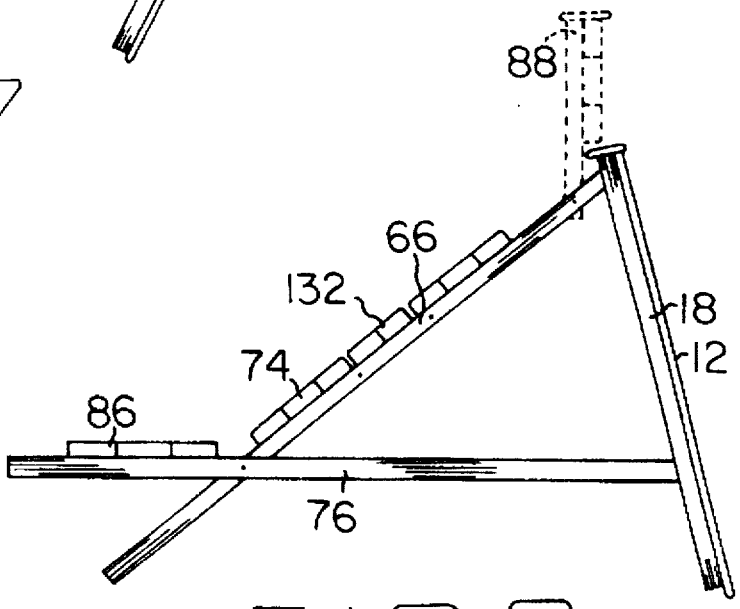
FIG. 8 is a side elevational view of the device shown in FIG. 5 in the second deployment orientation.
Figure 9:
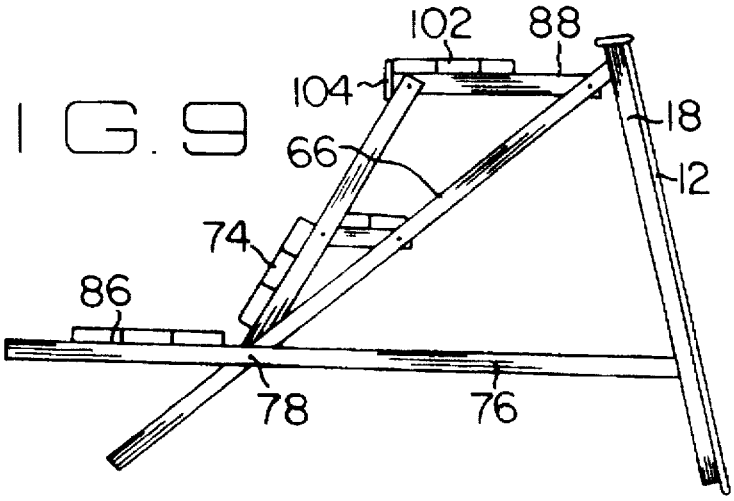
FIG. 9 is a side elevational view of the device shown FIG. 5 in a deployed orientation.

Additionally, back planks 88 are provided and have lower ends 92 with apertures 94 and use pivot pin 72 to secure it to the supplemental planks adjacent to their upper ends. The bank planks have upper ends 96 with apertures and a removable bolt 98. As depicted in FIG. 8, the back planks are pivotable about the lower ends to a raised orientation for storage and transportation when the removable bolt is removed. The back planks are pivotable for locking by the removable bolt into a horizontal position during deployment as said fence and bench. The back planks have transverse back rest planks 102 and a fascia 104 secured.

Included are front planks 106 which each having lower ends 108 with apertures 110 and a pivot pin 78. The pivot pin is used to secure the front planks to the supplemental planks adjacent the intermediate extents of the supplemental planks. The front planks each have upper ends 112 with apertures and a removable bolt 98 secured to the upper ends of the back planks 88 when the back blanks are deployed during deployment as a fence and bench.

Finally, intermediate planks 122 are next provided, the intermediate planks have a first end 124 with apertures and a pivot pin 126 secured above the intermediate extents of the supplemental planks, as shown in FIG. 5. The intermediate planks are pivotable about the pivot pin to a lowered orientation for storage and transportation. The intermediate planks have a second end 128 with apertures and a removable bolt 130 secured to intermediate extents of the front planks 106. The intermediate planks have transverse intermediate planks 132 secured thereto.

The present invention comprises a free-standing fence built in sections that can be temporarily installed and easily disassembled and moved to another location. It is made of wood and consists of tongue and groove siding mounted on a frame, eight feet long, supported on four inch square legs. Two braces extend out horizontally to form the supports for an eight feet long bench. The seat is formed with 2×6 inch planks. The fence can be made in different length sections, 14 feet for example, that can be easily moved by two people. When assembled each fence section stands six or seven feet high and is slightly angled back, supported by two or more of the four inch square legs (depending on the section length). These are fastened to the upper portion of the fence's backside at about a 45 degree angle. An equal number of the 2×4 inch braces are horizontally fastened to the backside of the fence and the legs, extending behind the legs a couple of feet. The two planks are positioned on top of the extended part of the braces to tie the legs together and create a seat or shelf.

Sections of the free standing fence may be assembled around the perimeter of a selected area. Weights such as cement blocks may be hung from the braces to keep the fence sections from blowing over when there are strong winds.

The present invention enables a person to easily install a temporary fence around an area to give it some privacy. It can also be utilized for outdoor storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved standing privacy fence which is collapsible and includes a deployable bench comprising in combination:

a rectangular sheet formed with long parallel upper and lower edges and short generally vertical end edges, the sheet being formed of a plurality of generally vertically extending planks, the sheet including a pair of interior planks for strengthening the sheet, the interior planks being proportionately spaced from the end edges of the rectangular sheet and one another, each interior plank having an upper edge and a lower edge, the upper edge of each interior plank being adjacent the long parallel upper edge of the rectangular sheet, the lower edge of each interior plank being adjacent the long parallel lower edge of the rectangular sheet;

a pair of long supplemental planks each having upper edges with pivot pins pivotally securing the upper edges of the supplemental planks to the interior planks of the sheet adjacent to the upper edge thereof, the supplemental planks being spaced a distance from the end edges essentially equal to the spacing of the interior planks of the sheet, the supplemental planks having transverse backrest planks extending past the supplemental planks to have a length essentially equal to the width of the sheet, the supplemental planks being positioned away from the sheet to form a right triangular cross sectional configuration when the fence is deployed;

additional planks having intermediate extents with pivot pins coupled to intermediate extents of the supplemental planks and having interior ends with removable bolts coupled to an intermediate extent of the interior planks for allowing the supplemental planks to retain the sheet and supplemental planks in said right triangular configuration when the fence is deployed but to allow removal of the removable bolt for pivoting the supplemental and additional planks parallel to the interior planks during storage and transportation, the additional planks having transverse seating planks spaced from the ends thereof remote from the interior planks;

back planks having lower ends with apertures and a pivot pin secured to the supplemental planks adjacent to their upper edges, the bank planks having upper ends with apertures and a removable bolt, the back planks being pivotable about the lower ends to a raised orientation for storage and transportation when the removable bolt is removed, the back planks being pivotable for locking by the removable bolt into a horizontal position during deployment as said fence and bench, the back planks having transverse back rest planks and a fascia secured thereto;

front planks each having lower ends with apertures and a pivot pin secured to the supplemental planks adjacent the intermediate extents of the supplemental planks, the front planks each having upper ends with apertures and a removable bolt secured to the upper ends of the back planks when the back blanks is deployed; and intermediate planks having a first end with apertures and a pivot pin secured above the intermediate extents of the supplemental planks and pivotable to a lowered orientation for storage and transportation, the intermediate planks having a second end with apertures and a removable bolt secured to intermediate extents of the front planks, the intermediate planks having transverse intermediate planks secured thereto.

2. A standing privacy fence which is collapsible and includes a deployable bench comprising, in combination:

a rectangular sheet formed with long parallel upper and lower edges and short vertical end edges, the sheet being formed of a plurality of generally vertically extending planks, the sheet including vertically strengthening planks adjacent to the upper and lower edges and end edges;

a pair of long supplemental planks having upper edges with pivot pins pivotally securing the upper edges of the supplemental planks to the strengthening planks of the sheet adjacent to the upper edge thereof, the supplemental planks being spaced a distance essentially equal to the width of the vertically strengthening planks of the sheet, the supplemental planks being positionable adjacent to the sheet for storage and transportation and being movable away from the sheet to form an A-shaped cross-sectional configuration when the fence is deployed;

additional planks having an intermediate extent with pivot pins coupled to intermediate extents of the supplemental planks and having interior ends with removable bolts coupled to an intermediate extent of the strengthening planks for allowing the supplemental planks to retain the sheet and supplemental planks in said A-shaped configuration when the fence is deployed but to allow removal of the removable bolts for pivoting the supplemental and additional planks parallel to the strengthening planks during storage and transportation, the additional planks having transverse seating planks adjacent to exterior ends thereof remote from the strengthening planks; and back planks having lower ends with apertures and a pivot pin secured to the supplemental planks adjacent to their upper edges and pivotable to a raised orientation for storage and transportation and pivotable to a lower position during deployment as said fence and bench, the back planks having transverse back rest planks secured thereto.

* * * * *